United States Patent [19]

Jansons

[11] 3,936,907

[45] Feb. 10, 1976

[54] MOLDED HINGE CONSTRUCTION

[75] Inventor: Eric G. Jansons, Schaumburg, Ill.

[73] Assignee: DeSoto, Inc., Des Plaines, Ill.

[22] Filed: Mar. 19, 1975

[21] Appl. No.: 559,840

[52] U.S. Cl. ..... 16/171; 297/55; 16/147; 16/149; 16/167; 16/181

[51] Int. Cl.[2].. E05D 1/06; E05D 15/50; E05D 5/02

[58] Field of Search..... 16/147, 128 R, 135, 171, 16/149, 181, 148, 150, 158, 187, 159, 167, 174; 297/440, 55

[56] References Cited

UNITED STATES PATENTS

| | | | |
|---|---|---|---|
| 2,990,571 | 7/1961 | Buchholtz | 16/171 |
| 3,423,786 | 1/1969 | Arias et al. | 16/171 |
| 3,685,093 | 8/1972 | Sanders et al. | 16/147 |

*Primary Examiner*—G. V. Larkin
*Attorney, Agent, or Firm*—Arnstein, Gluck, Weitzenfeld & Minow

[57] ABSTRACT

A hinge construction molded from a plastic composition material and comprising first and second cooperating components, the first component including a pair of spaced parallel ribs, each having a circular opening, the second component including a pair of spaced ears, each having a boss on its outer surface. In assembled relation the ears are disposed adjacent respective ribs and the bosses are journalled in respective openings. In assembling the components the ribs are caused to spread apart to permit entrance of the bosses into respective openings.

6 Claims, 14 Drawing Figures

FIG. 1
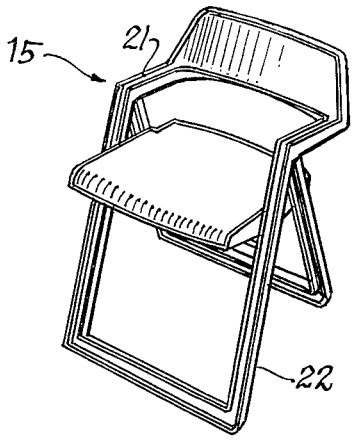
FIG. 2
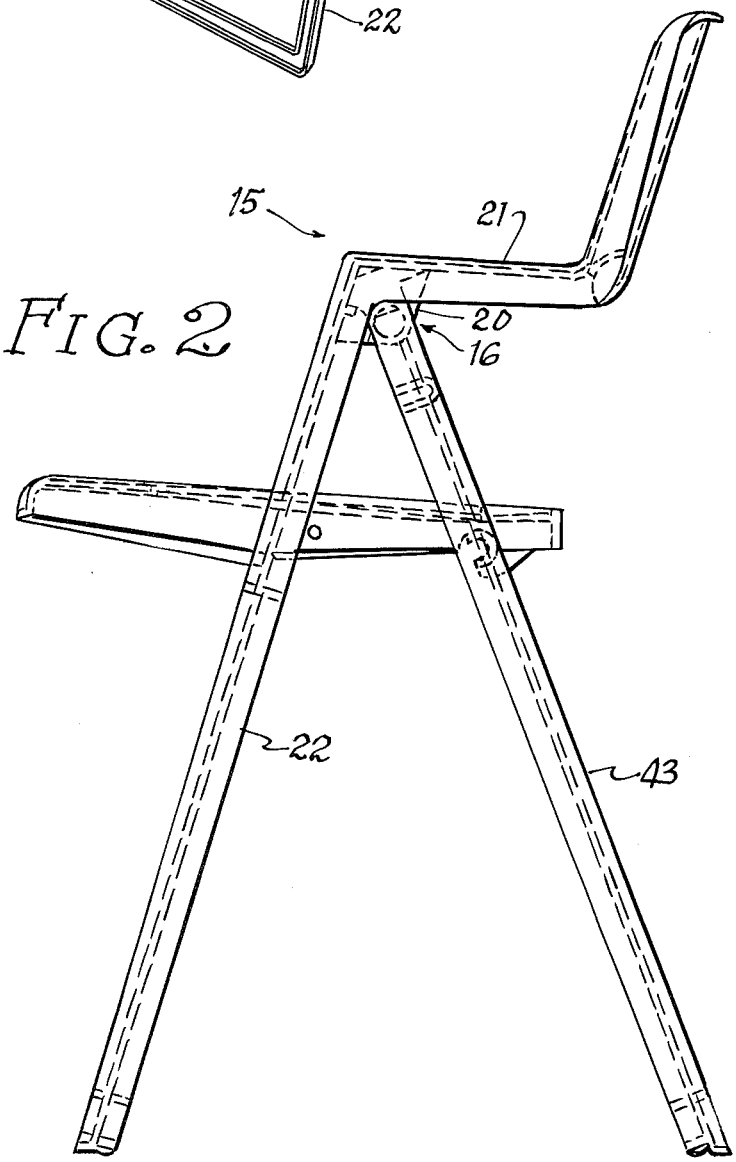
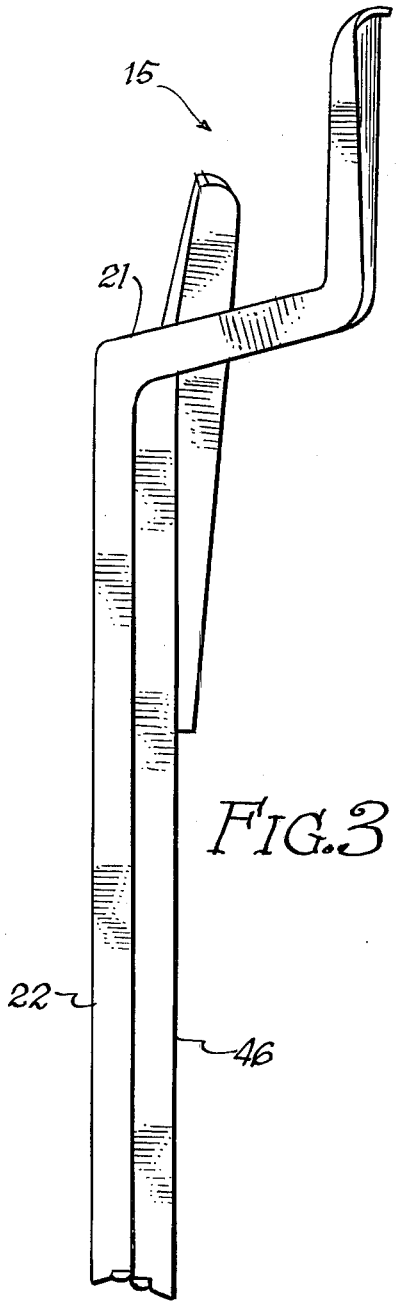
FIG. 3

FIG. 4
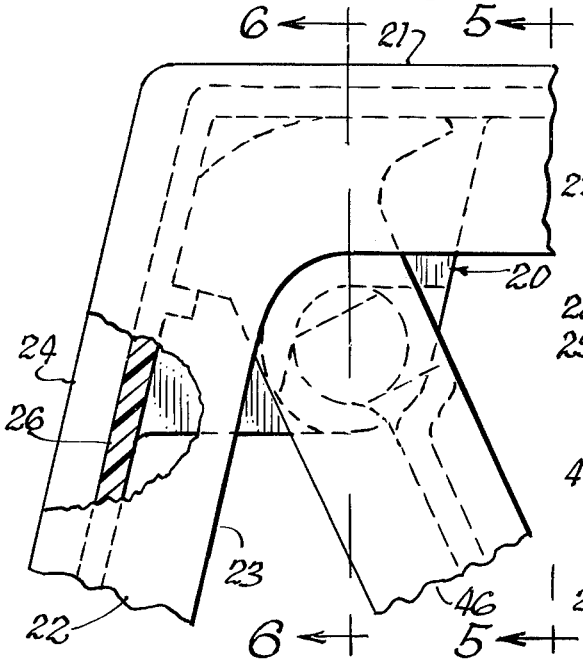
FIG. 5
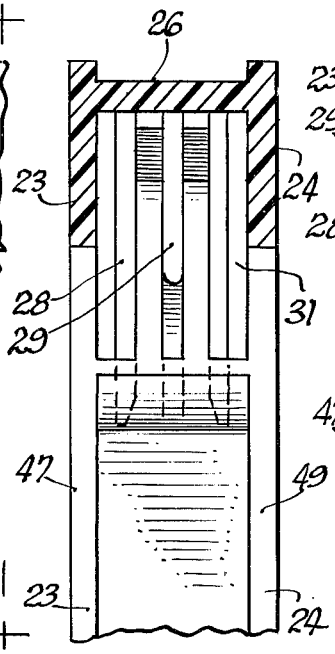
FIG. 6
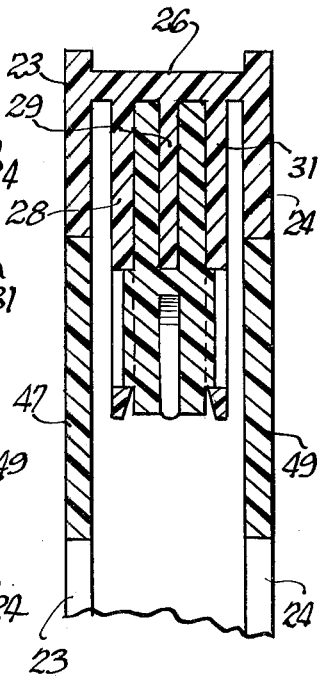
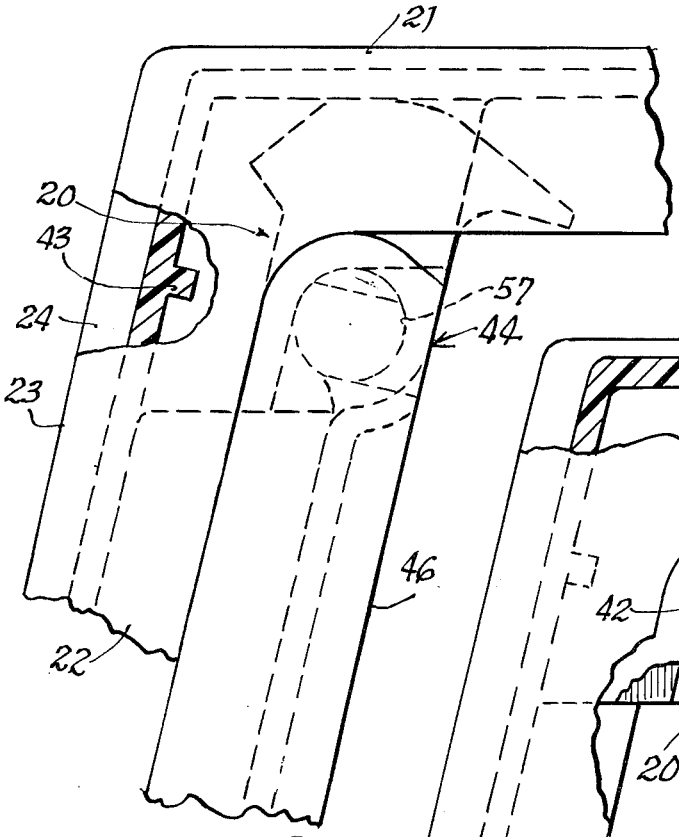
FIG. 7
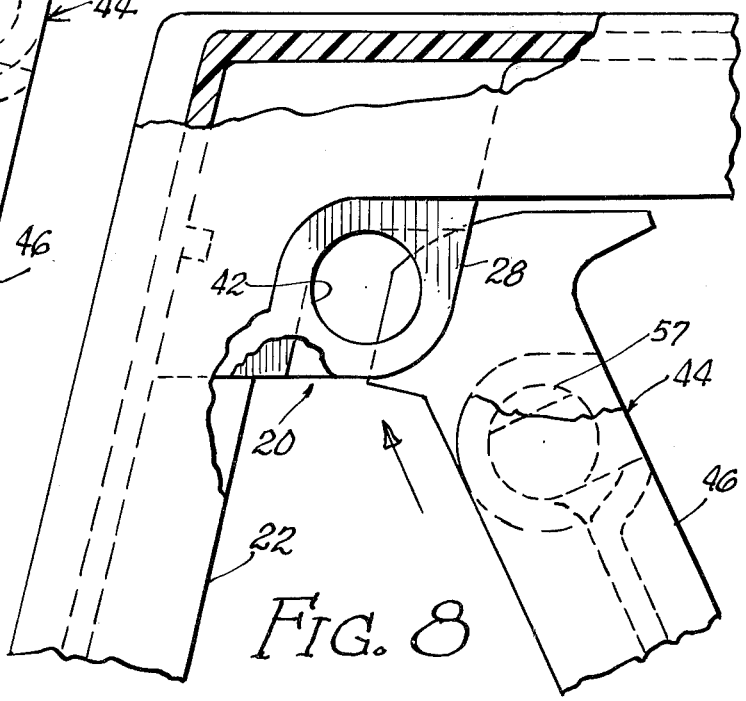
FIG. 8

MOLDED HINGE CONSTRUCTION

BACKGROUND OF THE INVENTION

The present invention relates to a molded hinge construction which is adaptable for use in folding type chairs and in other articles or devices particularly, where such articles are formed of molded plastic or other moldable material.

The hinge of the present invention lends itself to being molded as an integral part of an article formed of plastic or other moldable material. The hinge embodies the requisite strength and rigidity for withstanding substantial strains and stresses to which it would be subjected in service. Furthermore, no loose parts are required in assembly, the assembly operation requiring merely locating the two cooperating parts in proper registration and snapping the same into operative engagement. For purposes of illustration, the hinge of my invention is shown in the drawings as being applied to a folding chair formed of molded plastic material.

BRIEF DESCRIPTION OF THE DRAWING

FIG. 1 is a front perspective view of a folding chair embodying a hinge in accordance with the present.

FIG. 2 is a side elevational view, on an enlarged scale, of the chair illustrated in FIG. 1.

FIG. 3 is a view similar to FIG. 2, but showing the chair in folded condition.

FIG. 4 is a fragmentary side elevational view, on an enlarged scale, with a part broken away, showing the construction of the chair and hinge in assembled relation.

FIG. 5 is a cross-sectional view taken substantially on line 5—5 of FIG. 4.

FIG. 6 is a cross-sectional view taken substantially on line 6—6 of FIG. 4.

FIG. 7 is a view similar to FIG. 4, but showing the chair and hinge in closed condition.

FIG. 8 is a view similar to FIG. 4 showing the hinge elements in partially engaged relation.

BRIEF DESCRIPTION OF PREFERRED EMBODIMENT

Figure 9:
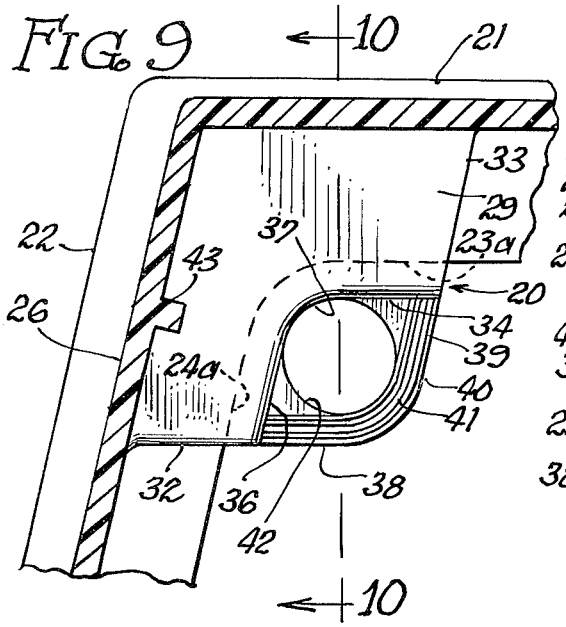
FIG. 9 is a vertical cross-sectional view of one hinge component, taken substantially on line 9—9 of FIG. 10.
Figure 10:
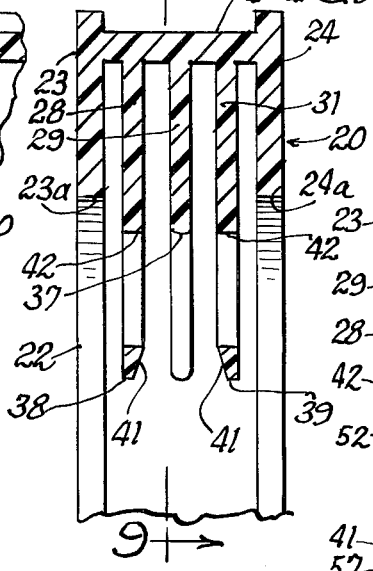
FIG. 10 is a cross-sectional view taken substantially on line 10—10 of FIG. 9.

Referring to the drawings, the hinge 16 of the present invention is shown integrally incorporated in a folding chair 15 molded from plastic or any suitable moldable material. As illustrated, one of the hinge components, indicated generally by the numeral 20, is located at the intersection of an armrest 21 and a front leg 22 and is integrally molded with said armrest and leg. Leg 22 is continuous with the armrest 21 and the cross-sectional configuration of the armrest and leg are identical, each having a pair of parallel side members 23 and 24 connected by a transverse web 26 in a generally H-shape formation. Formed integrally with the web 26 and disposed between the members 23 and 24 in parallel relation, are three spaced ribs or ears 28, 29 and 31. The central rib 29 is shaped substantially as illustrated in FIG. 9, terminating in outer edges 32 and 33 and intersecting edges 34 and 36, both of which merge into an arcuate edge 37. Each of the outer ribs 28 and 31 is shaped substantially as illustrated in FIG. 9 and terminates in outer edges 38 and 39 which are in registration with edges 32 and 33 respectively, of rib 29, the edges 38 and 39 being connected by an arcuate edge portion 40. The ribs 28 and 31 extend beyond the edges 34, 36 and 37 of the central rib 29, with the surface of each inner marginal edge portion 41 being beveled, as shown. As will be seen in FIG. 10, the beveled surfaces 41 are disposed in confronting relation. Each of the outer ribs 28 and 31 is provided with a circular opening 42, said openings being in coaxial registration with each other and with the arcuate edge 37. A shoulder 43 is integrally formed on the web 26 of the leg 22 to function as a stop, as will hereinafter be explained. As seen in FIG. 9, the edge portions 23*a* and 24*a* of the members 23 and 24 are parallel to respective edge portions 34 and 36.

Figure 11:
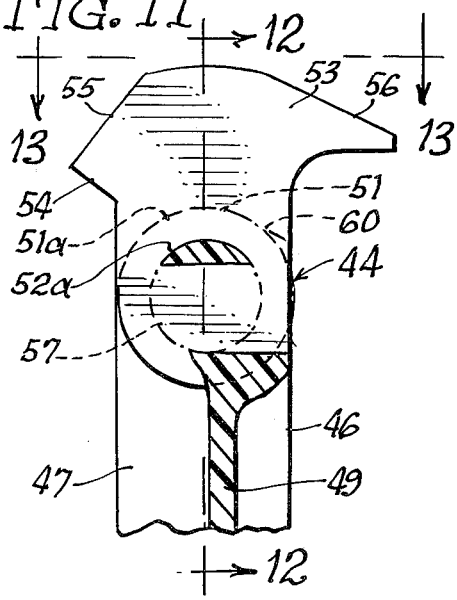
FIG. 11 is a cross-sectional view of a cooperating hinge component taken substantially on line 11—11 of FIG. 12.
Figure 12:
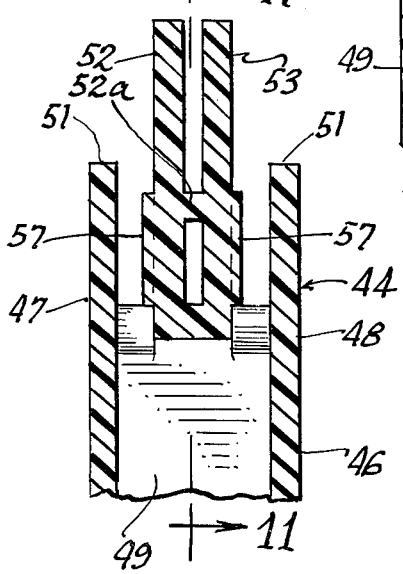
FIG. 12 is a cross-sectional view taken substantially on line 12—12 of FIG. 11.
Figure 13:
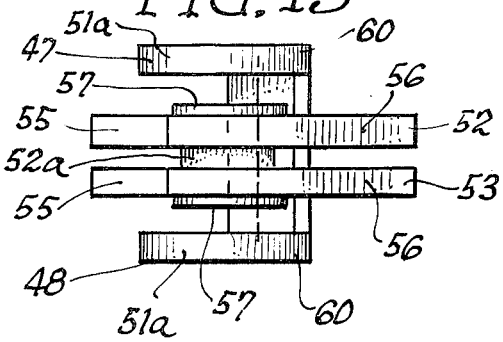
FIG. 13 is a top plan view looking in the direction of the arrows 13—13 of FIG. 11.

The cooperating hinge component 44 is illustrated as being an integral part of a molded leg 46 of the chair. Referring to FIGS. 11 and 12, the body of the leg 46 comprises a pair of spaced parallel side members 47 and 48 connected by an integral web 49 and substantially H-shape, in cross section. Web 49 terminates at its upper end short of the upper edges 51 of the side members 47 and 48. Each of said upper edges includes an arcuate portion 51*a* and a straight portion 60 tangent thereto. Extending upwardly from the web 49 intermediate the members 47 and 48 are a pair of spaced ears 52 and 53, shaped substantially as illustrated in FIGS. 11 and 12, and provided with abutment edge portions 54, 55 and 56. Each of the ears 52 and 53 is provided on its outer surface with a circular boss 57, with said bosses being in coaxial registration and also coaxial with the arcuate edge portion 51*a*. An integral bridging portion 52*a* reinforces ears 52 and 53 against flexing.

Figure 14:
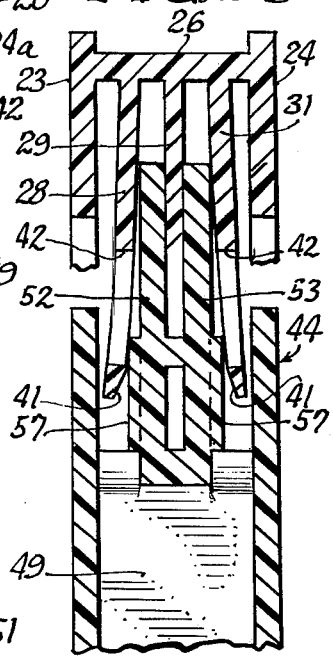
FIG. 14 is a vertical cross-sectional view showing the hinge components in partially engaged relation.

The two hinge components 20 and 44 may be readily assembled in the manner illustrated in FIGS. 8 and 14. The ears 52 and 53 are inserted in the space between the ribs 28 and 29 and 29 and 31, the entrance into said spaces being facilited by the beveled edges 41 on the ribs 28 and 31. As seen clearly in FIG. 14, the ribs 28 and 31 are caused to spread or to be cammed outwardly upon engagement with the bosses 57. Continued inward movement of the hinge component 44 relative to the component 20 will dispose the bosses 57 in axial registration with the openings 42, permitting the bosses 57 to enter into said openings, at which point, the normal resilience of the ribs 28 and 31 causes said ribs to resume their normal condition locking the two components 20 and 44 in assembled relationship while permitting relative movement of the components. As seen in FIGS. 4, 6 and 7, in assembled relation, the side members 23 and 24 are in planar registration with the side members 47 and 49, respectively, and the arcuate edges 51*a* of component 44 are concentric with and contiguous to the arcuate edges 37 of component 20.

It will be understood that the degree of relative movement between the hinge components 20 and 44 may be varied depending upon the ultimate use of the hinge construction. In the present application of the hinge in a chair, the limits of relative movement of the hinge components are shown in FIGS. 4 and 7. In the open or in use position shown in FIGS. 4, 5 and 6, certain edge portions of leg 46 abut the armrest 21 and leg 22 and constitute weight bearing surfaces. For example, edge portions 55 abut web 26 of 22, edge portions 56 abut web 26 of arm 21, edge portions 60 abut edge portions 34, and the peripheries of bosses 57 abut the walls of openings 42. Also, edge portions 54 engage the shoulder 43 which functions as a limiting stop for leg 46. It will be understood that the relationships above described apply to corresponding parts of both legs 46. In the closed or collapsed position, illustrated in FIGS. 3 and 7, leg 46 lies adjacent leg 22.

Various changes coming within the spirit of my invention may suggest themselves to those skilled in the art; hence, I do not wish to be limited to the specific embodiments shown and described or uses mentioned, but intend the same to be merely exemplary, the scope of my invention being limited only by the appended claims.

I claim:

1. A molded hinge construction comprising first and second cooperating components molded from a plastic composition material, the first component including a pair of spaced parallel ribs integral with a transversely extending web, an intermediate rib integral with said web and disposed intermediate and in spaced relation to said parallel ribs, each of said parallel ribs having a circular opening with said openings being in coaxial registration, the second component including a pair of spaced ears, each having on its outer surface a circular boss with said bosses being in coaxial registration and journalled in respective circular openings, said ears being received in respective spaces between said parallel and intermediate ribs with the intermediate rib being received between said ears.

2. The invention as defined in claim 1 including cooperating means on said components for limiting the relative movement between said components.

3. The invention as defined in claim 1 in which the parallel ribs include beveled edges adjacent the openings to facilitate assembly of said components.

4. A molded hinge construction comprising first and second components molded from a plastic composition material, the first component including a pair of spaced parallel side members and a transversely extending web integral with said side members, a pair of parallel ribs disposed normal to said web and spaced from said parallel side members and from each other, a central rib intermediate and in spaced relation to said pair of ribs and disposed normal to said web, each of said parallel ribs having a circular opening with said openings being in coaxial registration, the second component including a pair of spaced ears, each having on its outer surface a circular boss with said bosses being in coaxial registration and journalled in respective circular openings, said ears being received in respective spaces between said parallel and intermediate ribs with the intermediate rib received between said ears.

5. The invention as defined in claim 4 in which the second component includes a pair of side walls parallel to and spaced outwardly of said spaced ears with each side wall being in coplanar registration with a respective side member of said first component.

6. The invention as defined in claim 5 in which the side members and side walls have cooperating interengaging edges with certain of said edges constituting weight bearing surfaces.

* * * * *